United States Patent [19]

Mata

[11] Patent Number: 5,024,621

[45] Date of Patent: Jun. 18, 1991

[54] SINGLE BLOCK FOR FIXING ELECTROCONDUCTOR CABLES TO VEHICLE BATTERY TERMINALS

[76] Inventor: Francisco R. E. Mata, Avenida"F" con Avenida "D",, El Pinar El Paraiso, Caracas, Venezuela

[21] Appl. No.: 486,762

[22] Filed: Mar. 1, 1990

[51] Int. Cl.[5] ..... H01R 4/30

[52] U.S. Cl. ..... 439/771; 439/766

[58] Field of Search ..... 439/756-758, 439/766, 770, 771

[56] References Cited

U.S. PATENT DOCUMENTS

| | | | |
|---|---|---|---|
| 2,073,980 | 3/1937 | Williams et al. | 439/771 |
| 2,543,540 | 2/1951 | Anderson | 439/771 |
| 3,204,216 | 8/1965 | Ausherman | 439/771 |

FOREIGN PATENT DOCUMENTS

| | | | |
|---|---|---|---|
| 1144931 | 10/1957 | France | 439/771 |
| 7705612 | 11/1978 | Netherlands | 439/771 |

*Primary Examiner*—Paula A. Bradley
*Attorney, Agent, or Firm*—McGlew & Tuttle

[57] ABSTRACT

This invention relates to a novel single block for fixing electroconductor cables to battery terminals. The single block piece has a hollow essentially parallepiped configuration, the hollow region having an ellipsoidal shape wherein the battery terminals are housed. The front end of the single block piece expands upwards, the expanded region being cross-sectionally hollow. The lower region of the front face of the single block piece has a hole with a threaded inner surface where a screw or the like is threadably inserted. A semicircular plate is fixed to the tip of the screw. The plate slides through the hollow region in the single block as the screw is being threaded in and thereby the plate will exert pressure on the battery terminal. The expanded region of the front end of the single block piece has on its upper end a hole with a threaded inner surface where a screw or the like is threadably inserted thus exerting pressure on a cable or the like and thereby the cable will be housed in the hollow region of the expanded portion of the single block piece front end. The fixing system affords the user the advantage of being able to integrate, or not, the single block piece comprising the vehicle battery terminal.

2 Claims, 2 Drawing Sheets

SINGLE BLOCK FOR FIXING ELECTROCONDUCTOR CABLES TO VEHICLE BATTERY TERMINALS

FIELD AND BACKGROUND OF THE INVENTION

The present invention relates to a block for fixing electroconductor cables to vehicle battery terminals in general and more particularly to a single-block assembly with a clamping arrangement for exerting pressure on a battery terminal.

Battery terminal clamps are known which include a follower clamping element which is positioned in a hole for receiving a battery terminal. U.S. Pat. No. 2,073,980 issued to Williams et al shows such an arrangement in which the follower clamping element may be urged by a screw member into engagement with the terminal.

U.S. Pat. No. 3,204,215 issued to Ausherman discloses an arrangement wherein an opening for receiving a battery terminal is provided with a follower clamping element movable by a screw and the cable is connected to the clamping assembly by a screw arrangement which maintains the cable and contact with the clamping assembly.

U.S. Pat. No. 2,543,540 teaches an arrangement with a clamping opening and a member which is movable by a clamping bolt.

Dutch Patent 7,705,612 discloses an arrangement in which a terminal opening is provided with longitudinal ribs for receiving a battery terminal. A screw member is provided for engaging the battery terminal within the hole or opening. The cable is connected to the clamp assembly laterally of the terminal opening.

SUMMARY AND OBJECTS OF THE INVENTION

According to the invention, an electroconductor cable is fixed to a battery terminal formed of a single block piece with a hollow essentially parallepiped configuration, the hollow piece forming a hole of an ellipsoidal shape for receiving a battery terminal. The single block piece is provided with a front end which extends upwardly. The extended front end is hollow in cross-section. A lower region of a front face of the single block piece is provided with a hole with threaded inner surface for receiving a screw or the like. The screw, threadably inserted in the threaded hole, is provided with a semi-circular plate which is fixed to the tip of the screw. The plate is provided within the hollow region for sliding through the hollow region as the screw is threaded into the threaded hole. Upon threading the screw, the plate exerts pressure on the battery terminal for clamping the battery terminal. The front end expanded region is provided with a threaded hole on an upper end. The threaded hole receives a screw or the like which is threadably inserted into the hole for exerting pressure on a cable which is housed in the hollow region of the expanded portion front end. The arrangement allows the user the advantage of being able to integrate, or not, the single block piece comprising the vehicle battery terminal.

This invention possesses the particularity of a single block piece for fixing electroconductor cables to battery terminals, the block having an essentially parallepiped hollow configuration where the battery terminal is housed. The piece has at the lower end of its front face a hole with a threaded inner surface where a screw or the like will be threadably inserted. A semicircular plate is fixed to the tip of the screw, and the plate will slide on the hollow region of the single block piece as the screw is being threaded in, thereby exerting pressure on the battery terminal. In the same manner, the electroconductor cable extending towards the battery terminal and housed in the hollow portion of the expanded region of the single block piece front end is secured by the pressure exerted by a screw as it is threaded through a hole located in the upper end of the expanded region of the piece. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
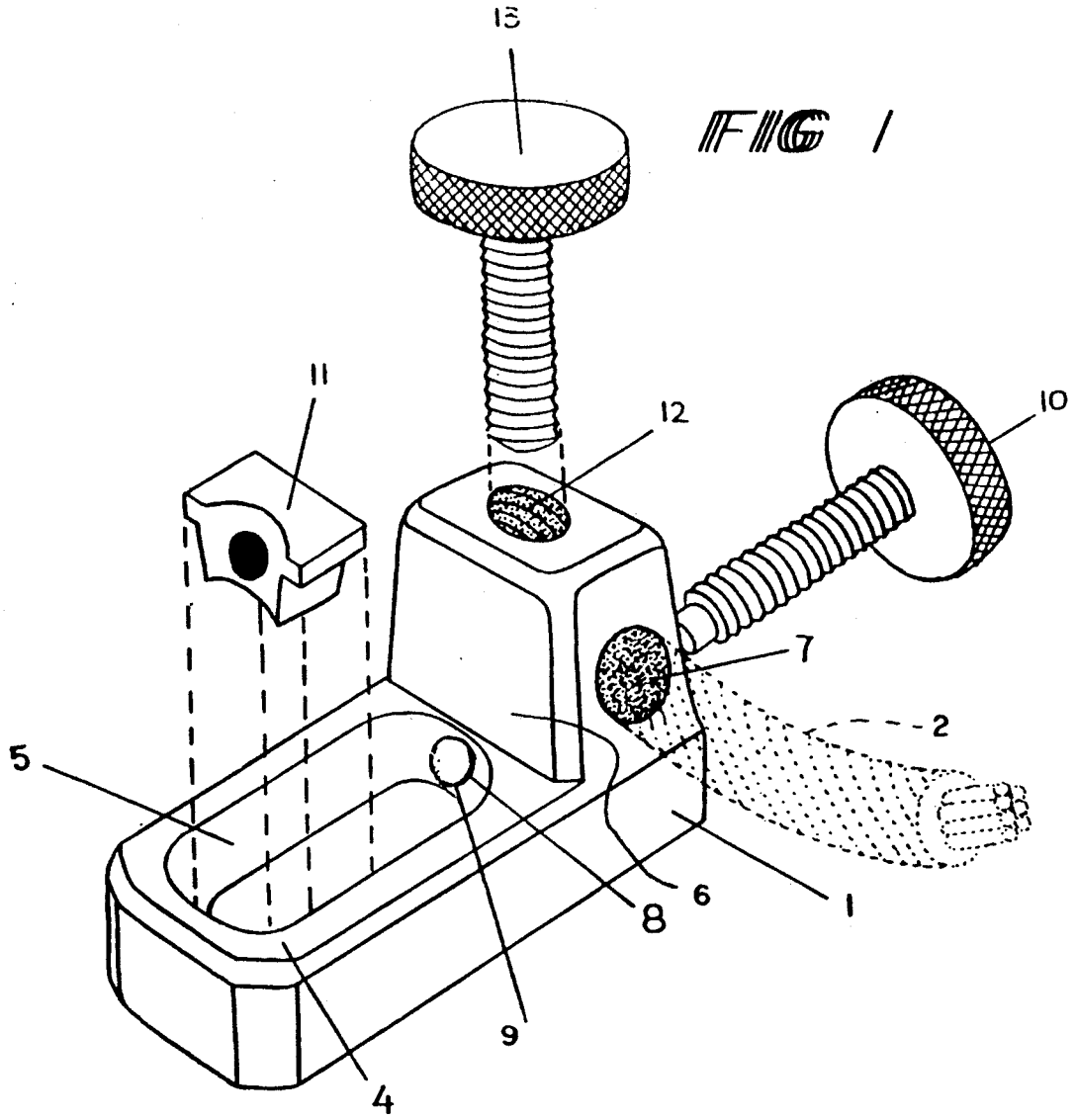
FIG. 1 is a perspective detailed view of the parts according to the single block cable fixing arrangement of the invention.
Figure 2:
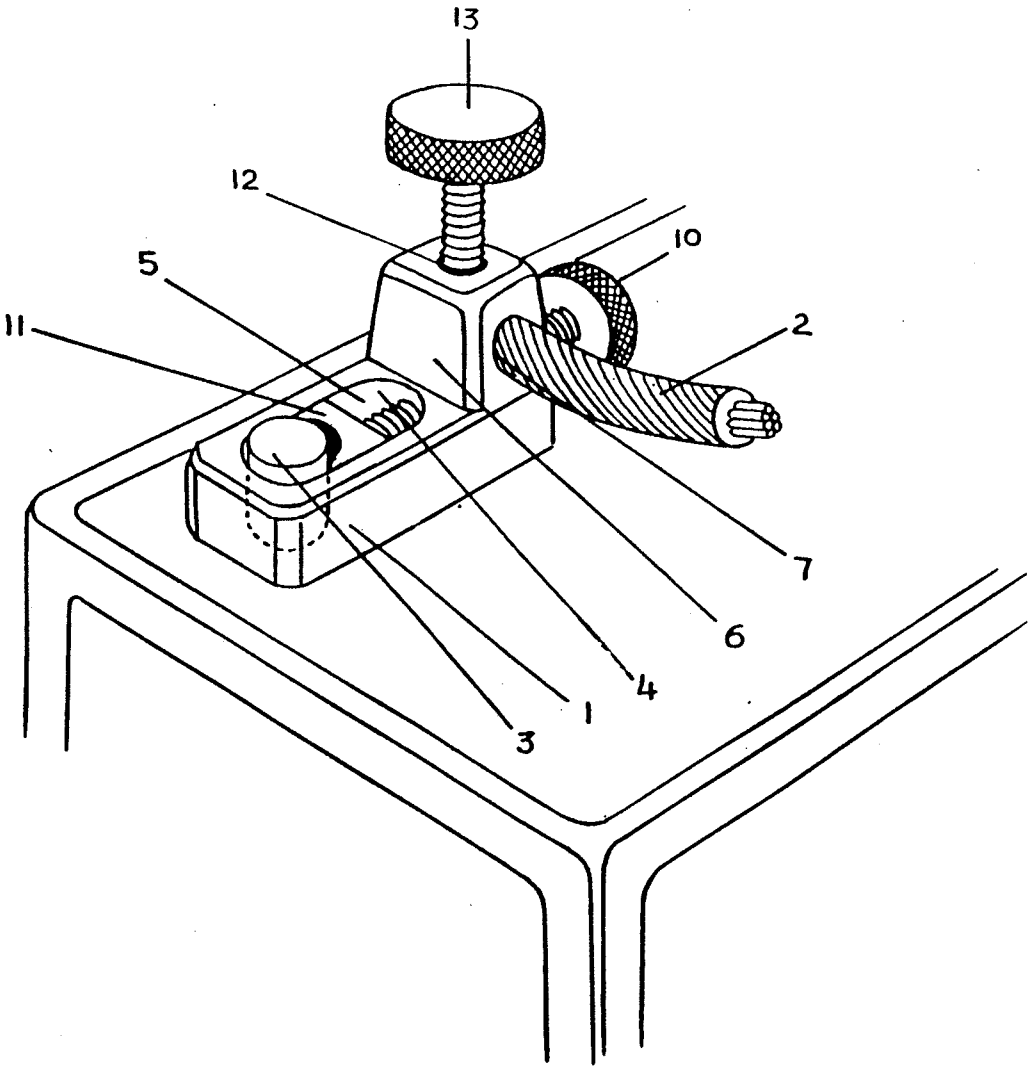
FIG. 2 is a perspective view showing the single block cable fixing arrangement according to the invention engaging a standard battery terminal for an automobile.

Referring to the drawings and in particular to FIG. 1, the invention comprises a single block 1 for fixing electroconductor cables 2 to a battery terminal 3 (see FIG. 2). The single block piece has an essentially parallepiped hollow configuration 4, the hollow region having an ellipsoidal shape 5 where the battery terminals 3 are housed. The front end 6 of the single block piece 1 expands upwards, the expanded region 7 being cross-sectionally hollow and the lower region of the front face of the piece 1 has a hole 8 with an inner threaded surface 9 where a screw 10 or the like is threadably inserted. At the tip of this screw a semicircular plate 11 is fixed which slides through the hollow region of the piece as screw 10 is being threaded and thereby the plate 11 exerts pressure on battery terminal 3. The expanded region of the front end of the piece 1 has on its upper end a hole with an inner threaded surface 12 where a screw 13 or the like is threadably inserted thus exerting pressure on a cable 2 or the like and thereby the cable 2 is housed in the hollow region 7 of the expanded portion of front end 6 of the piece. This fixing system is very novel and useful since the screws or the like which permit fixing the terminal afford the user the advantage of integrating or not the single block piece comprising the vehicle battery terminal 3.

While a specific embodiment of the invention has been shown and described in detail to illustrate the application of the principles of the invention, it will be understood that the invention may be embodied otherwise without departing from such principles.

I claim:

1. A single block piece for fixing electroconductor cables to vehicle battery terminals, comprising: an essentially hollow configuration formed in said single piece, said hollow configuration forming an essentially ellipsoidal shape for receiving a battery terminal; a front end portion of said single block piece extending upwardly defining an expanded region having a substantially hollow cross-section, said front end portion of said single block piece having a lower region defining a first hole with an inner threaded surface; a screw threadably inserted into said first hole; a circular plate positioned in said hollow region for sliding in said hollow region, said circular plate being fixable to said screw, movement of said screw in a direction toward said hollow region acting to urge said circular plate into engagement with a battery terminal, said expanded region having an upper end with a second threaded hole; a screw threadably positioned in said second threaded hole, said screw acting to exert pressure on a cable positioned in the hollow region of said expanded portion of said front end of said single piece.

2. A single block according to claim 1, wherein said single piece includes an essentially parallepiped.

* * * * *